US005080991A

United States Patent [19]

Ono et al.

[11] Patent Number: 5,080,991

[45] Date of Patent: Jan. 14, 1992

[54] ELECTROPHOTOGRAPHIC PHOTORECEPTOR WITH A HYDRAZONE

[75] Inventors: Hitoshi Ono, Yokohama; Atsuo Saita, Machida, both of Japan

[73] Assignee: Mitsubishi Kasei Corporation, Tokyo, Japan

[21] Appl. No.: 569,064

[22] Filed: Aug. 17, 1990

[30] Foreign Application Priority Data

Aug. 21, 1989 [JP] Japan ..... 1-214719

[51] Int. Cl.[5] ..... G03G 5/14

[52] U.S. Cl. ..... 430/73; 430/75; 430/78

[58] Field of Search ..... 430/59, 73, 75

[56] References Cited

U.S. PATENT DOCUMENTS

| | | | |
|---|---|---|---|
| 4,278,747 | 7/1981 | Murayama et al. | 430/82 |
| 4,485,160 | 11/1984 | Suzuki et al. | 430/59 |
| 4,666,809 | 5/1987 | Matsumoto et al. | 430/76 |
| 4,985,325 | 1/1991 | Kuroda | 430/73 |

FOREIGN PATENT DOCUMENTS 63-292141 11/1988 Japan .

OTHER PUBLICATIONS

Patent Abstracts of Japan, vol. 13, No. 250 (P-882) [3598], Jun. 12, 1989.

Patent Abstracts of Japan, vol. 13, No. 66 (P-828) [3414], Feb. 15, 1989.

*Primary Examiner*—John Goodrow

*Attorney, Agent, or Firm*—David G. Conlin; Peter F. Corless; Donald R. Castle

[57] ABSTRACT

An electrophotographic photoreceptor comprising a photosensitive layer which contains one or more hydrazone compounds represented by the formula:

[I]

wherein A represents a substituted or unsubstituted aryl or heterocyclic group; $R^1$, $R^2$ and $R^5$ are the same or different from each other and independently represent a hydrogen atom, or a substituted or unsubstituted alkyl or aryl group; $R^3$ and $R^4$ are the same or different from each other and independently represent a hydrogen atom, a halogen atom, a nitro group, or a substituted or unsubstituted alkyl, alkoxy, aryl or aryloxy group; $R^6$ represents a hydrogen atom, a halogen atom, or a substituted or unsubstituted alkyl or alkoxy group; $R^7$ represents a substituted or unsubstituted alkyl, aryl, aralkyl or heterocyclic group, or an allyl group, or binds to the phenyl group attached to the nitrogen atom as indicated by the dotted line in the formula I to form either one of the following rings together with the phenyl group and the nitrogen atom:

[II]

[III]

-continued
[IV]
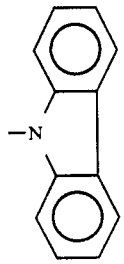
-continued
[V]
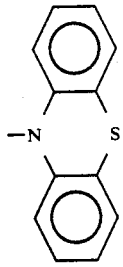
and n is an integer of 1 or 2, provided that A and $R^1$ may form a ring together with the carbon atom to which they are attached.
This photoreceptor has high sensitivity and excellent endurance.
13 Claims, 1 Drawing Sheet

ELECTROPHOTOGRAPHIC PHOTORECEPTOR WITH A HYDRAZONE

FIELD OF THE INVENTION

This invention relates to an electrographic photoreceptor, more particulaly, to a highly sensitive electrophotographic photoreceptor comprising a photosensitive layer which contains an organophotoconductive material.

BACKGROUND OF THE INVENTION

Hitherto, inorganic photoconductive materials such as selenium, cadmium sulfide and zinc oxide have been prevailingly applied to the photosensitive layer of photoreceptor for electrophotography. However, selenium and cadmium sulfide have to be recovered as poisonous substance, and further selenium is poor in heat resistance as it is crystallized when heated. Cadmium sulfide and zinc oxide, are poor in moisture resisitance, and zinc oxide is also deficient in printing endurance. Thus, efforts have been made for researching and developing a novel photosenstive material and novel photoreceptor.

A remarkable progress has been made recently in the studies on the use of organophotoconductive materials for the photosensitive layer of electrophotographic photoreceptor, and some of such organophotoconductive materials have been put to practical use.

The organophotoconductive materials have many advantages over the inorganic. For example, they are light in weight, it is by far easier to form a film and to produce a photosensitive layer by making use of them, and among them some are capable of producing a transparent photoreceptor.

Recently, the so-called function divided type of photoreceptor—in which the generation and transport of charge carriers are separately effected by different compounds—has become the main object of development since this type of photoreceptor is most effective in attaining high sensitivity, and some orgnophotoreceptors of such type have already been put to practical use.

As the transport material for the charge carrier, there is known either a high molecular photoconductive compound such as polyvinyl carbazole or a low molecular photoconductive compound dispersed or dissolved in a binder polymer.

The organic low molecular photoconductive compound can produce the photoreceptor excellent in mechanical properties since it is possible to select a polymer having excellent film-forming properties, flexibility, adhesivness, etc., as a binder for the compound. However, it is difficult to find out such a low molecular compound suited for making a highly sensitive photoreceptor.

SUMMARY OF THE INVENTION

An object of the invention is to provide a highly sensitive electrophotographic photoreceptor having an organic low molecular photoconductive compound.

Another object of the invention is to provide an high electrophotographic photoreceptor excellent in endurance.

The other objects of the invention will be apparent from the descriptions hereinafter described.

This invention provides an electrophotografic photoreceptor comprising a photosensitive layer which contains one or more hydrazone compounds represented by the formula:

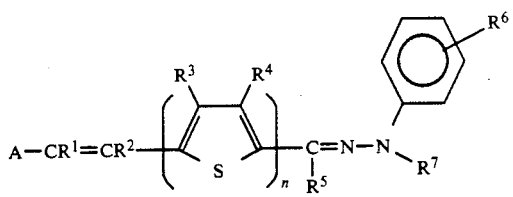

[I]

wherein A represents a substituted or unsubstituted aryl or heterocyclic group; $R^1$, $R^2$ and $R^5$ are the same or different from each other and independently represent a hydrogen atom, or a substituted or unsubstituted alkyl or aryl group; $R^3$ and $R^4$ are the same or different from each other and independently represent a hydrogen atom, a halogen atom, a nitro group, or a substituted or unsubstituted alkyl, alkoxy, aryl or aryloxy group; $R^6$ represents a hydrogen atom, a halogen atom, or a substituted or unsubstituted alkyl or alkoxy group; $R^7$ represents a substituted or unsubstituted alkyl, aryl, aralkyl or heterocyclic group, or an allyl group, or binds to the phenyl group attached to the nitrogen atom as indicated by the dotted line in the formula I to form either one of the following rings together with the phenyl group and the nitrogen atom:

[II]

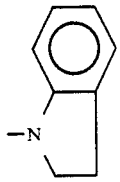

[III]

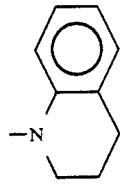

[IV]

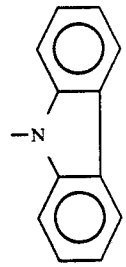

[V]

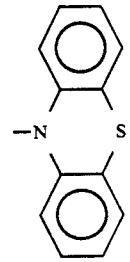

and n is an integer of 1 or 2, provided that A and $R^1$ may form a ring together with the carbon atom to which they are attached.

DESCRIPTION OF THE PREFERRED EMBODYMENTS

Figure 1:
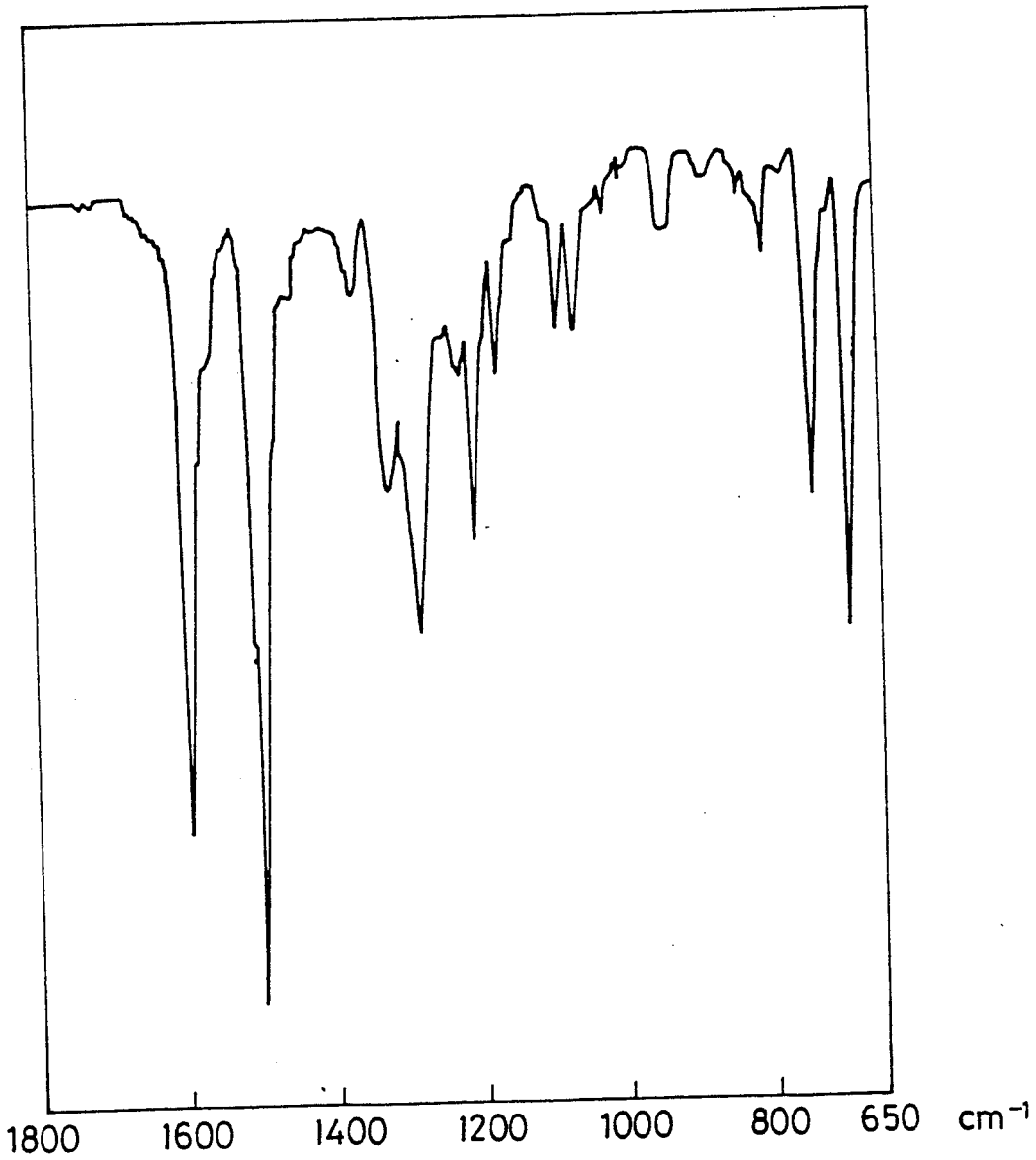
FIG. 1 shows an infrared spectrum of the hydrazone compound obtaied in Preparation Example 3.

The invention will be described in detail hereinafter.

The photoreceptor according to the invention is disposed on a conductive support and has a photosensitive layer which contains the hydrazone of the formula I.

The symbol of "A" in the formula I represents an aryl group derived from an aromatic ring such as benzene, naphthalene, anthracene, pyrene, perylene, phenanthrene, fluoranthene, acenaphthene, acenaphthylene, azulene, fluorene, indene, tetralin, or naphthacene; or a heterocyclic group derived from a heterocyclic compound which includes a nitrogen-containing heterocyclic compound such as pyrrole, indole, pyrazole, pyridine, acridine, phenazine, carbazole, indoline, phenothiazine and tetrahydroquinoline; a oxygen-containing heterocyclic compound such as furan, benzofuran and xanthene; and a sulfur-containing heterocyclic compound such as thiophene, benzothiophene and thioxanthene. Each of these aryl group and heterocyclic group may have one and more substituent groups. Examples of such substituent groups include a hydroxyl group; halogen atoms such as chlorine, bromine and iodine atoms; alkyl groups such as methyl, ethyl, propyl, butyl and hexyl; alkoxy groups such as methoxy, ethoxy and butoxy; an allyl group; aralkyl groups such as benzyl, naphthylmethyl and phenethyl; aryloxy groups such as phenoxy and tolyoxy; arylalkoxy groups such as benzyloxy and phenethyloxy; aryl groups such as phenyl and naphthyl; arylvinyl groups such as styryl and naphthylvinyl; dialkylamino groups such as dimethylamino and diethylamino; diarylamino groups such as diphenylamino and dinaphthylamino; diaralkylamino groups such as dibenzylamino and diphenethylamino; N-alkyl-N-arylamino groups such as N-methyl-N-phenylamino; N-aralkyl-N-arylamino groups such as N-benzyl-N-phenylamino; diheterocyclic amino groups such as dipyridilamino and dithienylamino; or a diallylamino group.

"A" is preferably a group selected from a phenyl group having substituted amino group, a polycyclic aryl group, a nitrogen-containing heterocyclic group and an oxygen-containing heterocyclic group.

The symbols of "$R^1$", "$R^2$" and "$R^5$" independently represent a hydogen atom; an alkyl group such as methyl, ethyl, propyl, butyl or hexyl; or an aryl group such as phenyl or tolyl. $R^1$, $R^2$ and $R^5$ may be the same or different from each other, among which a hydrogen atom, a lower alkyl group such as methyl, ethyl and propyl or a phenyl group is preferable. The alkyl and aryl groups may have one or more substituent groups. The substituent groups include a hydroxyl group; halogen atoms such as chlorine, bromine and iodine atoms; alkyl groups such as methyl, ethyl, propyl, butyl and hexyl; alkoxy groups such as methoxy, ethoxy and butoxy; an allyl group; aralkyl groups such as benzyl, naphthylmethyl, phenethyl; aryloxy groups such as phenoxy and tolyoxy; arylalkoxy groups such as benzyloxy and phenethyloxy; aryl groups such as phenyl and naphthyl; arylvinyl groups such as styryl; naphthylvinyl; dialkylamino groups such as dimethyamino and diethylamino; diarylamino groups such as diphenylamino and dinaphthylamino; diaralkylamino groups such as dibenzylamino and diphenethylamino; di-heterocyclic amino groups such as dipyridilamino and dithienylamino; or a diallylamino group.

The symbols of "$R^3$" and "$R^4$" indenpendently represent a hydrogen atom; a halogen atom such as chlorine, bromine or iodine atom; an alkyl group such as methyl, ethyl, propyl, butyl or hexyl; an alkoxy group such as methoxy, ethoxy or butoxy; an aryl group such as phenyl or tolyl; an aryloxy goup such as phenoxy or tolyoxy; or a nitro group, among which a hydrogen atom, a lower alkyl group such as methyl, ethyl and propyl or a phenyl group is preferable. $R^3$ and $R^4$ may be the same or different from each other. Each of the alkyl, alkoxy, aryl and aryloxy groups may have one or more substituent groups. The substituent groups include a hydroxyl group; halogen atoms such as chlorine, bromine and iodine atoms; alkyl groups such as methyl, ethyl, propyl, butyl and hexyl; alkoxy groups such as methoxy, ethoxy and butoxy; and allyl group; aralkyl groups such as benzyl, naphthylmethyl and phenethyl; aryloxy groups such as phenoxy and tolyoxy; arylalkoxy groups such as benzyloxy and phenethyloxy; aryl groups such as phenyl and naphthyl; arylvinyl groups such as styryl and naphthylvinyl; dialkylamino groups such as dimethyamino and diethylamino; diarylamino groups such as diphenylamino and dinaphthylamino; diaralkylamino groups such as dibenzylamino and diphenethylamino; di-heterocyclic amino groups such as dipyridilamino, dithienylamino; or a diallylamino group.

The symbol of "$R^6$" represents a hydrogen atom; a halogen atom such as chlorine, bromine or iodine atom; an alkyl group such as methyl, ethyl, propyl, butyl or hexyl; or an alkoxy group such as methoxy, ethoxy or butoxy, among which a hydrogen atom, a lower alkyl group such as methyl, ethyl and propyl or a phenyl group is preferable. Each of the alkyl and alkoxy groups may have one or more substituent groups. The substituent groups include a hydroxyl group; halogen atoms such as chlorine, bromine and iodine atoms; alkyl groups such as methyl, ethyl, propyl, butyl and hexyl; or alkoxy groups such as methoxy, ethoxy and butoxy.

The symbol of "$R^7$" represents an alkyl group such as methyl, ethyl, propyl, butyl or hexyl; an aryl group such as phenyl, naphthyl, tolyl, methoxynaphtyl, anthryl, acenaphthyl, fluorenyl, biphnyl or styryl; an allyl group; an aralkyl group such as benzyl, naphthylmethyl or phnethyl; a heterocyclic group such as pyrrole, thiophene, furan, indole, pyrazole or pyridine; or binds to the phenyl group attached to the nitrogen atom in the formula I to form either one of the following rings II to V together with the phenyl group and the nitrogen atom.

[II]

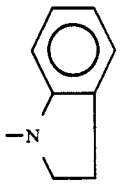

-continued

[III]

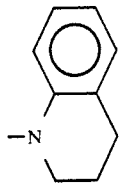

[IV]

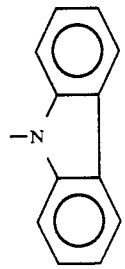

[V]

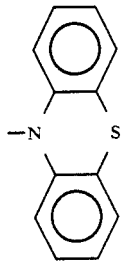

These alkyl, aryl, aralkyl and heterocyclic groups may have one or more substituent groups which are, for instance, a hydroxyl group; halogen atoms such as chlorine, bromine and iodine atoms; alkyl groups such as methyl, ethyl, propyl, butyl and hexyl; alkoxy groups such as methoxy, ethoxy and butoxy; an allyl group; aralkyl groups such as benzyl, naphthylmethyl and phenethyl; aryloxy goups such as phenoxy and tolyoxy; arylalkoxy groups such as benzyloxy and phenethyloxy; aryl groups such as phenyl and naphthyl; arylvinyl groups such as styryl and naphthylvinyl; dialkylamino groups such as dimethylamino and diethylamino; diarylamino groups such as diphenylamino and dinaphthylamino; diaralkylamino groups such as dibenzylamino and diphenethylamino; di-heterocyclic amino groups such as dipyridilamino, a dithienylamino group; or diallylamino.

Preferably, $R^7$ represents a substituted or unsubstituted naphthyl group or forms a ring of the formula II, III, IV or V.

The symbol of "n" in the formula I represents an integer of 1 or 2.

The symbol of A and $R^1$ may form a ring together with the carbon atom to which they are attached. Examples of such rings include the followings:

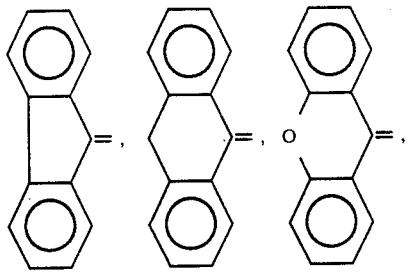

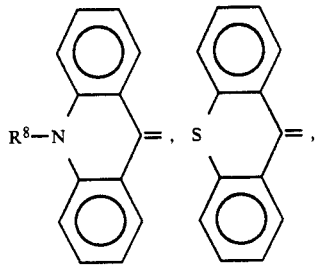

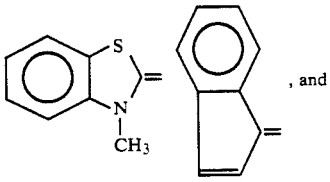

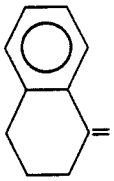

wherein $R^8$ represents a hydrogen atom, an alkyl, allyl, aralkyl or aryl group.

The hydrozone compounds of the formula I can be prepared by conventionally known processes. A preferred process among them is as follows:

An aldehyde or ketone is condensed with methylthiophene halide according to Wittig reaction followed by formylation according to Vilsmeier reaction, and then reacted with a proper hydrazine to obtain the desired hydrazone compound.

This process will be described hereinafter in detail.

As illustrated in the follwing reaction formula, an aldehyde or ketone of the formula VI (wherein A and $R^1$ are respectively the same as in the formula I) is reacted with the Wittig reagent of the formula VII (wherein $R^2$, $R^3$, $R^4$ and n are respectively the same as in the formula I), which can be obtained by the reaction of a halide with triphenylphosphine, in the presence of a basic catalyst in an organic solvent inert to the reaction to obtain a mixture of cis- and trans-isomers of a compound of the formula VIII.

The temperature in the reaction is 10°-200° C., preferably 20°-100° C. The solvent to be used is ,for instance, N,N-dimethyl formaide, N,N-dimethyl acetoamide, tetrahydrofuran, dioxane, benzene or toluene. The basic catalyst to be used is, for instance, butyl litium, phenyl litium, sodium methoxyd, sodium ethoxyd, or potassium t-butoxyd.

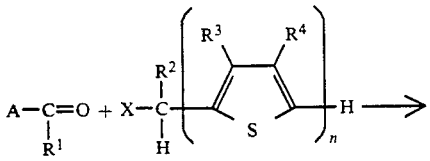

(VI) (VII)

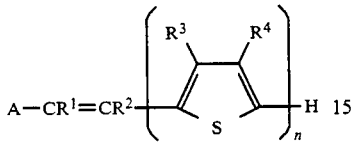

(VIII)

In the next step, each of the cis- and trans-isomers of the formula VIII may be used. Preferably, the mixture of them is used without separating each other.

Subsequently, a carbonyl group is introduced to the condensed compound of the formula VIII. The methods for this step are different between the instance wherein $R^5$ is H and that wherein $R^5$ is other than H. Each of the methods is as follows:

1. In the instance wherein $R^5$=H ;

The condensed compound of the formula VIII is reacted with a formylation-reagent such as N,N-dimethl formamide or N-methyl formanilide in the presence of phosphoryl chloride to obtain an aldehyde of a formula IX wherein $R^5$ is a hydrogen atom.

As a solvent for this reaction, an inert solvent such as O-dichrolobenzene or benzene may be used. Alternatively, if a large amount of the formylation-reagent is used, the reagent itself can act as the reaction solvent.

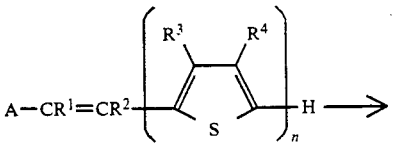

(VIII)

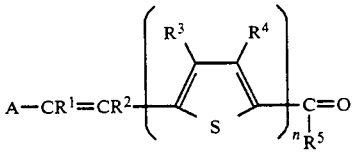

(IX) ($R^5$ = H)

2. In the instance wherein $R^5$=other than H ;

The condensed compound of the formula VIII is reacted with an acid halide of the formula X (wherein $R^5$ is the same as in the formula I but not the hydrogen atom) in the presence of Lewis acid such as aluminium chloride, iron chloride, or zinc chloride to obtain a ketone of the formula IX. As a solvent for this reaction, use is made of an inert solvent such as nitrobenzene, dichloromethane, or carbon tetrachloride.

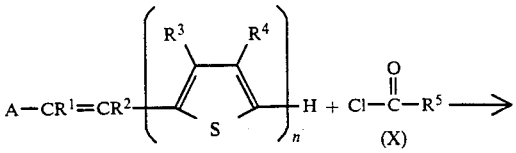

(VIII) (X)

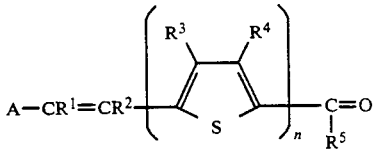

(IX) ($R^5 \neq H$)

After introducing the carbonyl group as the above, the aldehyde or ketone of the formula IX (wherein $R^5$ is the same as in the formula I) is reacted with a hydrazine of the following formula XI (wherein $R^6$ and $R^7$ are respectively the same as in the formula I) in an inert solvent at the temperature of 10°-100° C., preferably, 20°-100° C. to obtain the compound of the formula I. A salt of the above hydrazine together with hydrochloric acid or sulfuric acid can be used in stead of the hydrazine.

The inert solvent is, for instance, aromatic hydrocarbon such as benzene, toluene or chlorobenzene; alcohol such as methanol, ethanol or butanol; ether such as tetrahydrofuran, 1,2-dimethoxyethane or 1,4-dioxane; cellosolve such as methyl cellosolve or ethyl cellosolve; N,N-dimethylformamide; dimethylsulfoxid; or N-methylpyrrolidone. For promoting the reaction, to the reaction system is optionally added a promoting reagent such as p-toluene sulfonic acid, benzene sulfonic acid, hydrochloric acid, sulfuric acid, potassium acetate or sodium acetate.

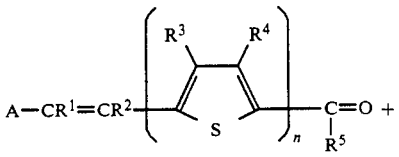

(IX)

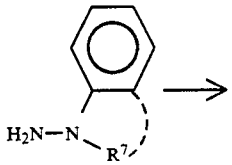

(XI)

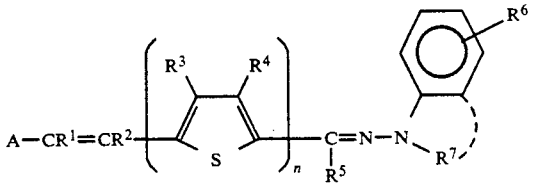

(I)

A highly purified compound of the formula I may be obtained by known purifying manners such as recrystallization, sublimation and column chromatography after each of or all of the steps in the preparation process.

The hydrazone compounds of the formula I, which is contained in the photosensitive layer of the photoreceptor according to the invention, exhibit a very exclent performance as an organophoto-semiconductor. Especially, when used as a charge transport material the compounds can impart particularly high sensitivity and excellent durabirity to the photosensitive layer or photoreceptor into which the compounds are to be included.

There are known a variety of types of photosensitive layers constituting the photoreceptor for electrophotography. The photoreceptor according to the invention may be any one of such known types. For example, the photosensitive layer used in the invention may be the one formed by adding, in a binder, the hydrazone compound and optionally a dye or electron attracting compound serving as a sensitizer; or the one formed by adding in a binder the hydrazone compound and photoconductive particles capable of forming charge carriers at an extremely high efficiency when exposed to the monochromatic or panchromatic light; or the one consisting of a charge transport layer of both the hydrazone compound and a binder, and a laminated charge generation layer of photoconductive particles capable of generating charge carriers at an extremely high efficiency upon absorption of the light optionally together with the binder.

In those photosensitive layer, the other known hydrazone or stilbene compounds having the excellent performance as an organophoto-semiconductor may be added in admixture with the hydrazone compound of the formula I.

In this invention, the hydrazone compound is preferably included in the charge transport layer of the photoreceptor which consists of the charge transport layer and the charge generation layer. Then, the prepared photoreceptor is especially high in sensistivity and low in residual potential, and is minimized in change of surface potential, drop of sensitivity and accumulation of residual potential even after repeated cyclic use, and is further excellent in the durability as well.

The electrophotographic photoreceptor according to the invention may be produced by a conventional method, for instance, by applying on a conductive substrate a coating solution obtained by dissolving the hydrazone compound of the formula I together with the binder in a suitable solvent and optionally adding thereto photoconductive particles capable of generating charge carriers at a very high efficiency upon adsorption of the light, a sensitizing dye, an electron attracting compound and/or other additives such as plasticizer and pigment; and drying the coat to form a photosensitive layer with a thickness of typically several to several ten microns. In the case of the photoreceptor consisting of both the charge generation layer and the charge transport layer, the coating solution above may be applied on the charge generation layer. Alternatively, the charge generation layer may be formed on the charge transport layer obtained by applying the coating solution.

The solvent used for the preparation of the coating solution is selected from those which can dissolve the hydrazone compound. The examples of such solvents include cyclic or acyclic ether such as tetrahydrofuran, 1,4-dioxane and dimethoxy ethane; ketones such as methyl ethyl ketone and cyclohexanone; aromatic hydrocarbons such as toluene and xylene; non-protonic polar solvents such as N,N-dimethyl formamide, acetonitrile, N-methylpyrrolidone and dimethyl sulfoxide; esters such as ethyl acetate, methyl formate and methyl cellosolve acetate; and chlorinated hydrocarbons such as dichloroethane and chloroform. It is of course necessary to select one which can dissolve the binder, too. As the binder, there can be mentioned polymers and copolymers of vinyl compounds such as styrene, vinyl acetate, vinyl chloride, acrylate, methacrylate and butadiene; and other polymers having the compatibility with the hydrazones, such as polyvinyl acetal, polycarbonate, polyester, polysulfone, polyphenylene oxide, polyurethane, cellulose ester, cellulose ether, phenoxy resin, silicon resin and epoxy resin. The binder is typically present in an amount of 0.5 to 30 times, preferably 0.7 to 10 times by weight of the amount of hydrazone.

The photoconductive particles, dye, pigment and electron attracting compound optionally added to the photosensitive layer may be known ones. As the photoconductive particles capable of generating the charge carriers at a prominently high efficiency upon absorption of the light, there can be included inorganic photoconductive particles such as the particles of selenium, selenium-tellurium alloy, selenium-arsenic alloy, cadmiumu sulfide and amorphous silicon, and organic photoconductive particles such as the particles of metal phthalocyanine, perinone pigment, thioindigo, quinacridone, perylene pigment, anthraquinone pigment, azo pigment, bisazo pigment, trisazo pigment tetrakis azo pigment and cyanine pigment. In particular, If combined with the metal photocyanine, the hydrazone of the formula I may produce a photoreceptor having an improved laser-sensitivity. The dyes usable in the invention include triphenylmethane dyes such as methyl violet, Brilliant Green and crystal violet; thiazine dyes such as methylene blue; quinone dyes such as quinizarin; cyanine dyes; pyrylium salt; thiapyrylium salts and benzopyrylium salts. As the electron attracting compound forming a charge transfer complex with the hydrazone compound, there can be mentioned quinones such as chloranil, 2,3-dicloro-1,4-naphthoquinone, 1-nitroanthraquinone, 1-chloro-5-nitroanthraquinone, 2-chloroanthraquinone and phenanthrenequinoe; aldehydes such as 4-nitrobenzaldehyde; ketones such as 9-benzoyl-anthracene, indandione, 3,5-dinitrobenzophenone, 2,4,7-trinitrofluorenone, 2,4,5,7-tetranitrofluorenone and 3,3',5,5'-tetranitrobenzophenone; acid anhydrides such as phthalic anhydride and 4-chloronaphthalic anhydride; cyano compounds such as tetracyanoethylene, terephthal malononitrile, 9-anthrylmethylidenemalononitrile, 4-nitro-benzal malononitrile and 4-(p-nitrobenzoyloxy)benzalmalononiotril; and phthalides such as 3-benzalphthalide, 3-(α-cyano-p-nitrobenzal)phthalide and 3-(α-cyano-p-nitrobenzal)-4,5,6,7-tetrachlorophthalide.

The photosensitive layer of the electrophotographic photoreceptor according to the invention may additionally contain a known type of plasticizer for improving the film-forming properties, flexibility and mechanical strength thereof. As the plasticizer to be added to the coating solution for those purpose, there can be used compounds such as a phthalic acid ester, phosphoric acid ester, epoxy compound, chlorinated paraffin, chlorinated fatty acid ester, and aromatic compound such as methylnaphthalene. In case of using the hydrazone compound as the charge transport material in the charge transport layer, a coating solution to be applied may have the same composition as the above-mentioned, but in this case, the photoconductive particles, dye, pigment and electron attracting compound may be excluded or added only in small quantities. The charge generation layer provided in this case may be a thin layer formed by applying the coating solution obtaied by dissolving or dispersing the photoconductive particles and, if necessary, the binder polymer, organic photoconductive material, dye, pigment, electron attracting compound and the like; and then drying the coat. Alternatively, the charge generation layer may be thin filmy layer formed from the photoconductive particles by vacuum deposition or other methods.

The photoreceptor formed in the manner described in the foregoings may additionally have an adhesive layer, an intermediate layer, a transparent insulating layer and the like, as desired. As the conductive substrate on which the photosensitive layer is formed, any of the known types generally used for the electrophotographic photoreceptor can be employed in the invention. Typical examples of such substrate are a drum or sheet made of a metal such as aluminium, stainless steel or copper; and a laminate or deposit of these metal foils. It is also possible to use a plastic film, plastic drum, paper, paper tube and the like which have been subjected to a conductive treatment by applying a conductive material such as metal powder, carbon black, copper iodide or high molecular electrolyte, together with a proper binder. Further, usable is a plastic sheet or drum which is made conductive by containing a conductive material such as metal powder, carbon black or carbon fiber.

The photoreceptor of the invention is not only high in sensitivity but also low in residual potential. In addition, the photoreceptor is less degraded due to light, so that the changes in surface potential and sensitivity, and acummulation of residual potential are small even after repeated use of the photoreceptor. For such reasons, it has excellent endurance.

EXAMPLES this invention will hereinafter be described in further detail referring to Examples, which are merely illustrative and by no means understood to be limitative to the scope of the invention hereinafter claimed. In the following Examles, all "parts" are by weight unless otherwise indicated.

Preparation Example 1

Twenty five grams of bromomethyl thiophene

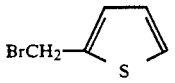

was dissolved in 250 ml of dried N,N-dimethyl formamide followed by adding 37 g of triphenyl phosphine thereto to prepare a Wittig reagent. Subsequently, 27 g of triphenyl amine aldehyde

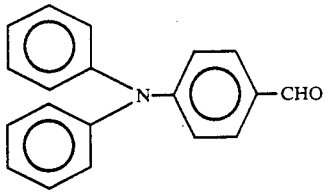

was added into the reaction mixture and then 41 g of 28% solution of sodium methylate in methanol was added dropwise into the mixture to complete the reaction for 90 minutes at the temperature of 70° C. After cooling, the reaction mixture was added into 500 g of ice-water followed by filtration and purification in a conventional manner to obtain 35 g of a known styrene compound.

Preparation Example 2

In 300 ml of N,N-dimethyl formamide, 15 g of the styrene compound prepared in Preparation Example 1 was reacted with phosphoryl chloride for 3 hours at the temperature of 70° C.

After cooling, the reaction mixture was poured into 300 g of ice-water followed by hydrolysis with NaOH, and then the desired phase was extrated, concentrated and purified in a conventional manner. Ten grams of brown viscous liquid was then obtained.

This compound was determined to be a styrene compound having a formyl group represented by the following formula from the results of elemental analysis listed below, mass spectrometric analysis and infrared spectral analysis.

Elemental analysis ($C_{25}H_{19}ONS$)

| | C (%) | H (%) | N (%) | S (%) |
|---|---|---|---|---|
| Calculated | 78.74 | 4.99 | 3.67 | 8.40 |
| Found | 78.50 | 4.97 | 3.81 | 8.62 |

Mass spectrometric analysis

Calcd. as $C_{25}H_{19}ONS$ MW = 381, $M^+$ = 381

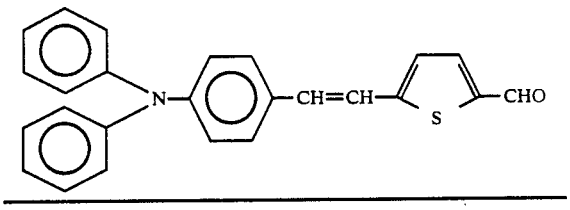

Preparation Example 3

In a mixture of 25 ml of methyl alcohol and 10 ml of chloroform, 2.5 g of the styrene compound prepared in Preparation Example 2 was reacted with 2.6 g of 1,1-diphenyl hydrazine for 30 minutes under refluxing.

After cooling, concentrating and purifying the reaction solution in a conventional manner, 2.1 g of orange crystalline (m.p.: 78°-80° C.) was obtained.

This compound was determined to be a hydrazone compound represented by the following formula from the results of elemental analysis listed below, mass spectrometric analysis and infrared spectral analysis (shown in FIG. 1).

| | Elemental analysis (as $C_{37}H_{29}N_3S$) | | | |
|---|---|---|---|---|
| | C (%) | H (%) | N (%) | S (%) |
| Calculated | 81.17 | 5.30 | 7.68 | 5.85 |
| Found | 81.20 | 5.21 | 7.51 | 6.08 |

Mass spectrometric analysis

Calcd. as $C_{37}H_{29}N_3S$ MW = 547, $M^+$ = 547

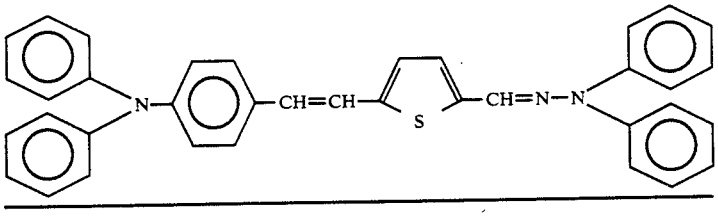

Example 1

0.4 parts of titanium oxyphthalocyanine pigment, 0.2 parts of polyvinyl butyral (S-LEC BH-3 manufactured by Sekisui Chemical Co., Ltd.) and 0.2 parts of phenoxy resin (PKHH manufactured by Union Carbide Corp.) were dispersed and broken into finely divided particles in 30 parts of 4-methoxy-4-methylpentanone-2 (manufactured by Mitsubishi Kasei corporation).

The resultant dispersion was coated on a deposited layer of aluminium evaporated on a polyester film of 75 μm in thickness by using a wire bar so that the coat after drying would amount to 0.2 g/m$^2$, and then the coat was dried to form a charge generation layer.

On this charge genenration layer was applied a coating solution obtained by dissolving 90 parts of the hydrazone compound prepared in Preparation Example 3 and 100 parts of a polycarbonate resin (Iupilon E-2000 manufactured by Mitsubishi Gas Chemistry Co.,Ltd.) in 900 parts of dioxane, and the coat was dried to form a charge transport layer of 17 μm in thickness.

The electrophotographic photoreceptor thus obtained is a dual-layered type. Measuring its sensitivity, or half-decay exposure ($E_{\frac{1}{2}}$), it is 2.6 $(\mu W/cm^2)^{-1}$.

The half-decay exposure is determined as follows: The photoreceptor is first charged in a dark place by-4.8 KV corona discharge, and then exposed to a light of wavelength 775 nm. The exposure amount required for reducing the surface potential to ½ of the initial surface potential(500V) is determined.

Example 2

A photoreceptor was prepared according to the procedure of Example 1 except for using a bisazo pigment of naphthalic acid represented by the following formula in stead of phthalocyanine pigment in Example 1.

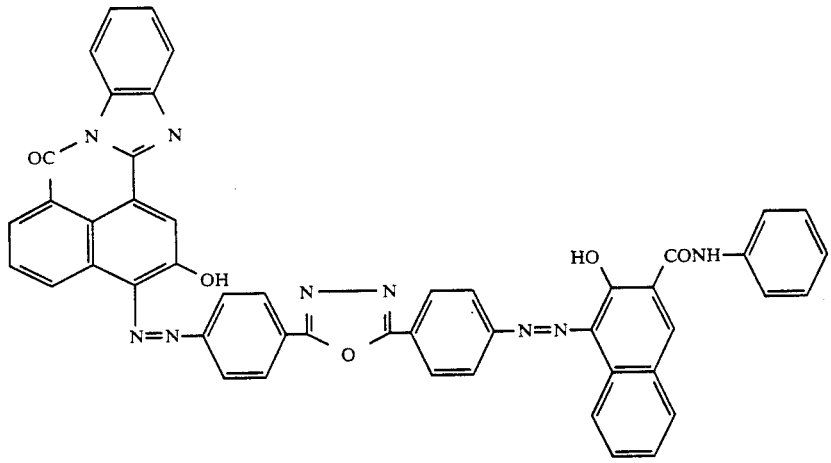

The photoreceptor was exposured to white light, after which half-decay exposure ($E_{\frac{1}{2}}$) was determined. It was 1.1 lux.sec.

Examples 3–18

Photoreceptors were prepared according to the procedure of Example 1 except for using hydrazone compounds represented in the following Table 1, which were prepared in the same manner as in Preparation Example 3, in stead of the hydrazone in Example 1.

Each sensitivity of the photoreceptors is also shown in Table 1.

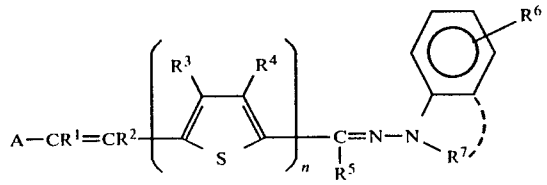
| Example No. | A | $R^1$ | $R^2$ | $R^3$ | $R^4$ | $R^5$ | $R^6$ | $R^7$ | n | Sensitivity $(\mu W/cm^2)^{-1}$ |
|---|---|---|---|---|---|---|---|---|---|---|
| 3 | 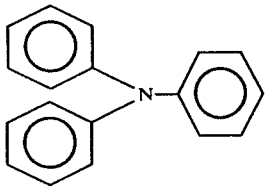 | H | H | H | H | H | H | 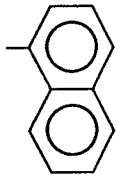 | 1 | 2.6 |
| 4 | 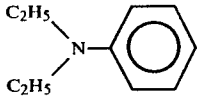 | H | H | H | H | H | H | 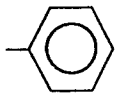 | 1 | 1.9 |
| 5 | 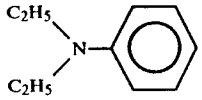 | H | H | H | H | H | H | 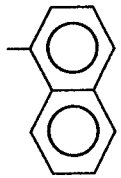 | 1 | 2.4 |
| 6 | 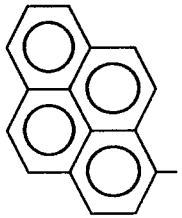 | H | H | H | H | H | H | 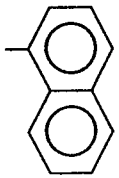 | 1 | 2.0 |

-continued
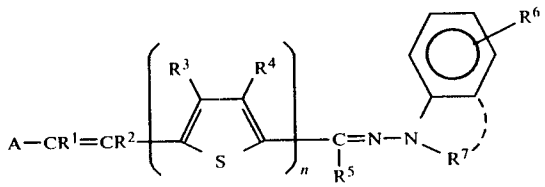
| Example No. | A | $R^1$ | $R^2$ | $R^3$ | $R^4$ | $R^5$ | $R^6$ | $R^7$ | n | Sensitivity $(\mu W/cm^2)^{-1}$ |
|---|---|---|---|---|---|---|---|---|---|---|
| 7 | 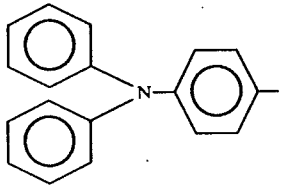 | $CH_3$ | H | H | H | H | H | 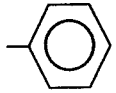 | 1 | 2.0 |
| 8 | 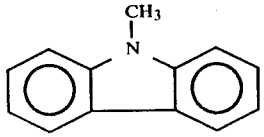 | $CH_3$ | $CH_3$ | H | H | H | H | $CH_3$ | 1 | 0.8 |
| 9 | 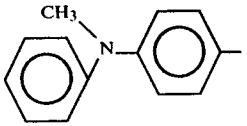 | $CH_3$ | 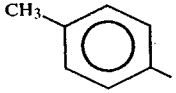 | H | H | H | | 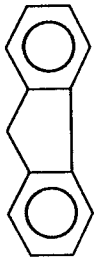 | 1 | 1.9 |

-continued
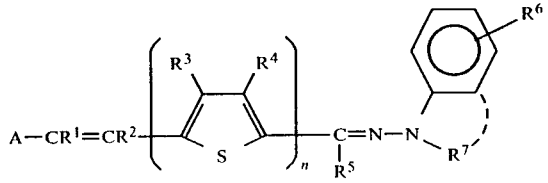
| Example No. | A | $R^1$ | $R^2$ | $R^3$ | $R^4$ | $R^5$ | $R^6$ | $R^7$ | n | Sensitivity $(\mu W/cm^2)^{-1}$ |
|---|---|---|---|---|---|---|---|---|---|---|
| 10 | 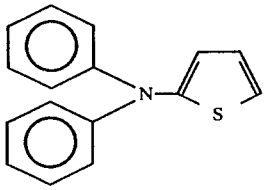 | 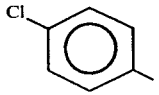 | $CH_3$ | H | H | H | H | $-CH_2CH=CH_2$ | 1 | 1.2 |
| 11 | 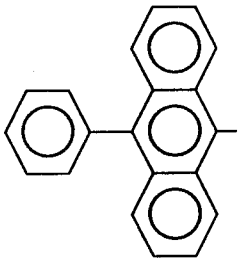 | H | H | $CH_3$ | $CH_3$ | H | Cl | 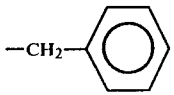 | 1 | 1.0 |
| 12 | 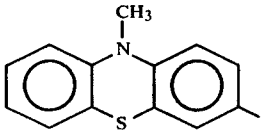 | H | H | Br | Br | H | H | 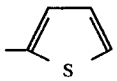 | 1 | 0.7 |
| 13 | 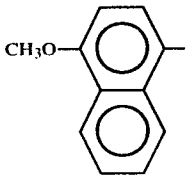 | H | H | H | $NO_2$ | $CH_3$ | | 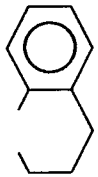 | 1 | 1.5 |

-continued
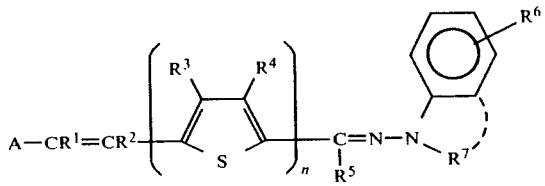
| Example No. | A | $R^1$ | $R^2$ | $R^3$ | $R^4$ | $R^5$ | $R^6$ | $R^7$ | n | Sensitivity $(\mu W/cm^2)^{-1}$ |
|---|---|---|---|---|---|---|---|---|---|---|
| 14 | 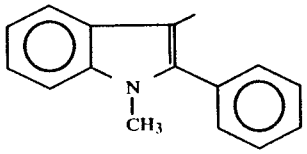 | H | H | $OCH_3$ | $OCH_3$ | 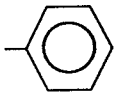 | 3-$CH_3$ | 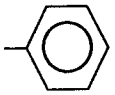 | 1 | 2.0 |
| 15 | 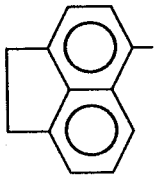 | H | H | 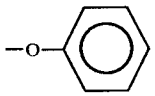 | 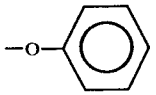 | $-CH_3$ | 4-$OCH_3$ | 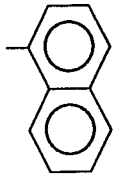 | 1 | 1.9 |
| 16 | 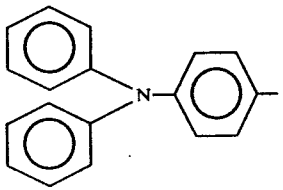 | H | H | H | H | H | H | 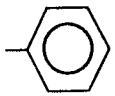 | 2 | 2.2 |

-continued
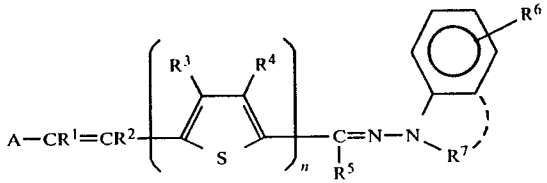
| Example No. | A | $R^1$ | $R^2$ | $R^3$ | $R^4$ | $R^5$ | $R^6$ | $R^7$ | n | Sensitivity $(\mu W/cm^2)^{-1}$ |
|---|---|---|---|---|---|---|---|---|---|---|
| 17 | 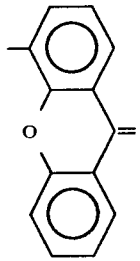 | | H | 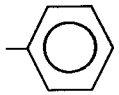 | 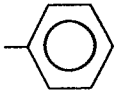 | H | | 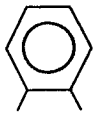 S 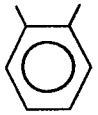 | 2 | 1.8 |
| 18 | 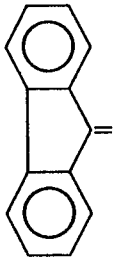 | | $CH_3$ | Br | Br | $CH_3$ | | 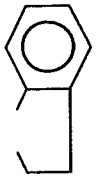 | 2 | 1.2 |

What is claimed is:

1. An electrophotographic photoreceptor comprising a photosensitive layer which contains one or more hydrazone compounds represented by the formula:

[I]

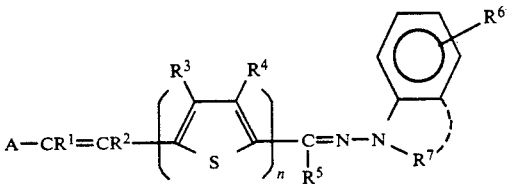

wherein A represents a substituted or unsubstituted aryl or heterocyclic group; $R^1$, $R^2$ and $R^5$ are the same or different from each other and independently represent a hydrogen atom, or a substituted or unsubstituted alkyl or aryl group; $R^3$ and $R^4$ are the same or different from each other and independently represent a hydrogen atom, a halogen atom, a nitro group, or a substituted or unsubstituted alkyl, alkoxy, aryl or aryloxy group; $R^6$ represents a hydrogen atom, a halogen atom, or a substituted or unsubstituted alkyl or alkoxy group; $R^7$ represents a substituted or unsubstituted alkyl, aryl, aralkyl or heterocyclic group, or an allyl group, or binds to the phenyl group attached to the nitrogen atom as indicated by the dotted line in the formula I to form either one of the following rings together with the phenyl group and the nitrogen atom:

[II]

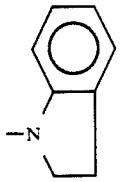

[III]

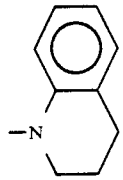

-continued

[IV]

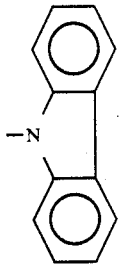

[V]

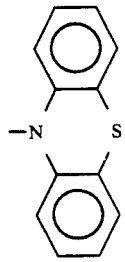

and n is an integer of 1 or 2, provided that A and $R^1$ may form a ring together with the carbon atom to which they are attached.

2. The photoreceptor according to claim 1, wherein A in the formula I represents a phenyl group substituted with N-substituted amino group, a polycyclic aryl group, a nitrogen-containing hetetocyclic group or an oxygen-containing heterocyclic group.

3. The photoreceptor according to claim 2, wherein A in the formula I represents a phenyl group substituted with N-substituted amino group.

4. The photoreceptor according to claim 3, wherein A in the formula I represents an N,N-diarylamino group.

5. The photoreceptor according to claim 4, wherein $R^7$ in the formula I represents a substituted or unsubstitued aryl group.

6. The photoreceptor according to claim 5, wherein $R^7$ in the formula I represents a substitued or unsubstituted naphthyl group.

7. The photoreceptor according to claim 4, wherein A in the formula I represents an N,N-diphenylamino group.

8. The photoreceptor according to claim 7, wherein $R^7$ in the formula I represents a substituted or unsubstituted aryl group.

9. The photoreceptor according to claim 8, wherein $R^7$ in the formula I represents a substituted or unsubstituted naphtyl group.

10. The photoreceptor according to claim 1, wherein A and $R^1$ form a ring together with the carbon atom to which they are attached.

11. The photoreceptor according to claim 1, wherein $R^1$,$R^2$,$R^3$,$R^4$,$R^5$ and $R^6$ independently represent a hydrogen atom, a lower alkyl group or a phenyl group.

12. The photoreceptor according to claim 1, wherein $R^7$ represents a substitued or unsubstituted naphthyl group.

13. The photoreceptor according to claim 1 wherein $R^7$ binds to phenyl group attached to the nitrogen atom as indicated by the dotted line in the formula I to form a ring of the formula II, III,IV or V together with the phenyl group and the nitorogen atom.

* * * * *